US010109470B2

(12) United States Patent
Hoyes

(10) Patent No.: US 10,109,470 B2
(45) Date of Patent: Oct. 23, 2018

(54) TIME OF FLIGHT DETECTION SYSTEM

(71) Applicant: Micromass UK Limited, Wilmslow (GB)

(72) Inventor: John Brian Hoyes, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 1 day.

(21) Appl. No.: 15/317,326

(22) PCT Filed: Jun. 11, 2015

(86) PCT No.: PCT/GB2015/000175

§ 371 (c)(1),
(2) Date: Dec. 8, 2016

(87) PCT Pub. No.: WO2015/189547

PCT Pub. Date: Dec. 17, 2015

(65) Prior Publication Data

US 2017/0125226 A1 May 4, 2017

(30) Foreign Application Priority Data

Jun. 12, 2014 (EP) ..... 14172214
Jun. 12, 2014 (GB) ..... 1410509.2

(51) Int. Cl.
*H01J 49/02* (2006.01)
*H01J 49/40* (2006.01)

(52) U.S. Cl.
CPC ..... *H01J 49/025* (2013.01); *H01J 49/40* (2013.01)

(58) Field of Classification Search
CPC ..... H01J 49/025; H01J 49/40; H01J 49/403; H01J 49/34; H01J 49/0004; H01J 49/0031
USPC ..... 250/281, 282, 283, 287
See application file for complete search history.

(56) References Cited

U.S. PATENT DOCUMENTS

| | | | | |
|---|---|---|---|---|
| 7,196,327 | B2 | 3/2007 | Thomson et al. | |
| 7,786,452 | B2 | 8/2010 | Ward et al. | |
| 7,858,937 | B2 | 12/2010 | Ogawa et al. | |
| 8,274,045 | B2 | 9/2012 | Bamberger et al. | |
| 8,569,690 | B2 | 10/2013 | Komatsu et al. | |
| 8,829,427 | B2 | 9/2014 | Brouard et al. | |
| 2013/0187041 | A1* | 7/2013 | Brouard | H01J 49/061 250/282 |
| 2017/0103879 | A1* | 4/2017 | Cooks | H01J 49/061 |

OTHER PUBLICATIONS

Tokanai, F. et al., *Development of Time-of-Flight Detector with Streak Camera*, IEEE Transactions on Nuclear Science, vol. 47, No. 6, pp. 1753-1757 (Dec. 2000).

* cited by examiner

*Primary Examiner* — Nicole Ippolito

(57) ABSTRACT

A ion detector system for a mass spectrometer is disclosed comprising a detector comprising an array of sensor pixels, wherein a dimension of the sensor pixels is <about 10 μm, and an aperture arranged and adapted such that a beam of charged particles or light passes through the aperture in use, wherein the aperture comprises a pinhole aperture or slit having a dimension comparable to, equal to, or less than the dimension of the sensor pixels.

16 Claims, 2 Drawing Sheets

TIME OF FLIGHT DETECTION SYSTEM

CROSS-REFERENCE TO RELATED APPLICATIONS

This application represents the U.S. National Phase of International Application number PCT/GB2015/000175 entitled "Time of Flight Detection System" filed 11 Jun. 2015, which claims priority from and the benefit of United Kingdom patent application No. 1410509.2 filed on 12 Jun. 2014 and European patent application No. 14172214.0 filed on 12 Jun. 2014. The entire contents of these applications are incorporated herein by reference.

FIELD OF THE PRESENT INVENTION

The present invention relates generally to mass spectrometry and in particular to methods of detecting ions, methods of mass spectrometry, ion detector systems and mass spectrometers. In particular, pixelated or position sensitive detectors for use in a detector system of a mass spectrometer are disclosed.

BACKGROUND

Streak cameras are known and comprise a versatile light detection instrument giving temporal information. Streak cameras have been used to measure electron bunches in synchrotrons, fast (femtosecond) laser pulses and plasma physics experiments.

Reference is made to IEEE transactions on Nuclear Science Vol. 47, No. 6, December 2000, p. 1753. Typically, in a streak camera pulsed incident light is converted to electrons by a photocathode. The electrons are then accelerated by a mesh electrode before the electrons pass between two parallel plate electrodes that have a temporally varying sweep voltage applied to them such that the electrons receive a deflection before they impinge upon a phosphorescent screen.

The signal from the screen is read by a position sensitive detector.

According to the known arrangement the position of the signal on the screen is directly related to the instantaneous sweep voltage that the electrons encountered when the electrons passed rapidly through or between the deflection plates. Temporal information is therefore converted to spatial information. Depending upon the application this reduces the requirements placed on the high speed digitising electronics used to capture the signal and/or increases the overall temporal resolution of the device.

The streak camera principle has been applied to Time of Flight detection of heavy ions in the radioactive ion beam facility at RIKEN (IEEE transactions on Nuclear Science Vol. 47, No. 6, December 2000, p. 1753). Two streak cameras were used to register secondary electrons produced by a heavy highly energetic ion passing through thin metallic films. The known device employed 100 MHz sinusoidal waveforms to deflect the beam in x and y dimensions onto a phosphor screen. The phosphorescence was then amplified and captured by a charged coupled device ("CCD").

The principle has also been applied to Time of Flight mass spectrometry whereby a ramp voltage is synchronized to the frame rate of a sensor that is set at about 20 MHz (bin width about 50 ns). Reference is made to WO 2012/010894 (ISIS).

As digital electronics gets faster so does the digitisation frequency of Time to Digital Converters and Analogue to Digital Converters which means that the deflection plates must sweep at a correspondingly faster rate.

Fast pixelated detectors having a bin width of about 100 ps are being developed to detect ions in systems using a microwave cavity resonator to sweep an electron beam across the surface of the fast pixelated detector. Such very fast detectors typically have a moderate number of pixels, a relatively large pixel size (e.g. about 0.5 mm) and operate in a time to digital conversion mode i.e. one bit of vertical information. To produce an intense electric field to sweep electrons for streak cameras in synchronization with state of the art digitizers capable of running at bin widths of typically about 100 ps or faster is challenging and expensive.

It is desired to provide an improved pixelated detector such that the maximum amount of data can be captured.

It is also desired to provide an inexpensive pixelated detector that is able to handle large amounts of data.

SUMMARY

According to an aspect there is provided an ion detector system for a mass spectrometer, comprising:

a detector comprising an array of sensor pixels, wherein a dimension of the sensor pixels is <about 10 μm;

an aperture arranged and adapted such that a beam of charged particles or light passes through the aperture in use, wherein the aperture comprises a pinhole aperture or slit having a dimension comparable to, equal to, or less than the dimension of the sensor pixels.

The approach according to various embodiments is distinct from conventional arrangements, such as the approach disclosed in WO 2012/010894 (ISIS) and IEEE transactions on Nuclear Science Vol. 47, No. 6, December 2000, p. 1753, in that a pinhole aperture or slit is used, through which passes a beam of charged particles or light, wherein the pinhole aperture or slit has a dimension comparable to, equal to, or less than a dimension of the sensor pixels.

It has been realised that a large amount of information is obtainable using a commercially available digital camera chip in an ion detector i.e. having a small pixel size <about 10 μm. Conventional arrangements in this field focus on how to modify the remaining apparatus so as to make use of fast pixelated detectors having large pixel sizes, see e.g. WO 2012/010894 (ISIS). There is no suggestion to modify the fast pixelated detector itself and pass a beam of charged particles or light through a pinhole aperture or slit having a dimension comparable to, equal to, or less than the dimension of the sensor pixels.

The beam of charged particles or light may comprise or correspond to a beam of ions, for example a beam of ions received from a mass spectrometer, or a beam of ions received from a Time of Flight mass spectrometer or analyser. The beam of charged particles or light may comprise a beam of electrons that are output from a microchannel plate. The microchannel plate may receive ions from a Time of Flight mass spectrometer or analyser.

The beam of charged particles or light may comprise photons or a beam of light, for example that is output from a device arranged and adapted to convert a beam of ions received from a mass spectrometer, or a beam of ions received from a Time of Flight mass spectrometer or analyser, into a beam of light.

The intensity of the beam of charged particles or light may vary with the intensity of a beam of ions received from a mass spectrometer in use.

The pinhole aperture or slit may serve as the object or virtual object that is reimaged onto the detector.

The detector may have a frame rate <about 250 frames per second and/or a bin width >about 4 ms. The detector may have >about $1\times10^6$ pixels.

The detector may be arranged and adapted to receive a beam of charged particles or light and output data corresponding to the position of the beam of charged particles or light on the array of sensor pixels.

The detector may be arranged and adapted to receive a beam of charged particles or light and output data corresponding to the intensity of the beam of charged particles or light.

The ion detector system may further comprise a phosphor screen arranged and adapted to receive a beam of charged particles that has passed through the aperture and output a beam of light. The direction of the beam of light outputted by the phosphor screen may be dependent on the position of the beam of charged particles impacting on the phosphor screen.

The ion detector system may further comprise a raster device arranged and adapted to sweep a beam of charged particles or light that has passed through the aperture across the phosphor screen in a raster manner. The raster device may comprise one or more deflection plates, for example a pair of deflection plates orientated orthogonally to each other. The ion detector system may further comprise a control system arranged and adapted to vary a voltage applied to the raster device in order to apply a time-varying voltage across the plates.

When the ion detector system is used with a beam of light, a raster device could comprise rotating mirrors, for example, that sweep the beam of light across a detector after it is passed through an aperture comprising a pinhole aperture or slit, as discussed herein.

The ion detector system may further comprise a first focusing device arranged and adapted to focus a beam of charged particles that has passed through the aperture onto the phosphor screen. The ion detector system may further comprise a second focusing device arranged and adapted to focus a beam of light emerging from the phosphor screen onto the detector.

The second focusing device may be arranged and adapted to focus a beam of light emerging from the phosphor screen onto the detector such that, upon impinging the detector, the beam of light has a width comparable to, equal to, or less than the dimension of the sensor pixels.

The ion detector system may further comprise a raster device arranged and adapted to sweep a beam of charged particles that has passed through the aperture across the detector in a raster manner.

The ion detector system may further comprise a first or further focusing device arranged and adapted to focus a beam of charged particles onto the detector.

The first or further focusing device may be arranged and adapted to focus a beam of charged particles onto the detector such that, upon impinging the detector, the beam of charged particles has a width comparable to, equal to, or less than the dimension of the sensor pixels.

The ion detector system may further comprise a control system arranged and adapted to vary a voltage applied to the raster device with the voltage applied to the first focusing device so as to maintain a width of the beam of charged particles at the phosphor screen or detector comparable to, equal to, or less than the dimension of the sensor pixels.

According to an aspect there is provided a mass spectrometer comprising an ion detector system as claimed in any preceding claim.

According to an aspect there is provided a method of detecting ions comprising:

providing a detector comprising an array of sensor pixels, wherein a dimension of the sensor pixels is <10 μm and an aperture; and passing a beam of charged particles or light through the aperture, wherein the aperture comprises a pinhole aperture or slit having a dimension comparable to, equal to, or less than the dimension of the sensor pixels.

According to an aspect there is provided a method of mass spectrometry comprising a method as described above.

According to an aspect there is provided an ion detector system for a mass spectrometer, comprising: a detector comprising an array of sensor pixels, wherein a dimension of the sensor pixels is <about 10 μm.

According to an embodiment there is provided a mass spectrometer detection system incorporating a commercially available digital camera chip. The commercially available digital camera chip may be used in a streak camera for an ion detector, optionally in a Time of Flight mass spectrometer.

According to an embodiment ions from a Time of Flight mass analyser strike a microchannel plate or conversion dynode to produce secondary electrons which are accelerated and focused through an aperture, for example a pinhole aperture or slit before being refocused, temporally deflected and scanned across a phosphor. Light from the phosphor may be imaged onto a digital camera sensor, such as a charged coupled device ("CCD") or a metal-oxide-semiconductor field-effect transistor ("MOSFET") such as those found in commercially available digital cameras.

Various embodiments allow an improvement in the speed of the acquisition system by a factor of an order of magnitude, for example about 100 ps to about 10 ps.

Commercially available digital cameras may comprise chips having a high number of pixels and have a high photoelectron capacity per pixel. A single pixel in a commercially available digital camera chip may have an electron well capacity in excess of about 50,000 photo electrons and can employ 16-bit digitisation. The pixel size of a commercially available digital camera chip may be about 5 μm or less than about 10 μm.

A downside can be that commercially available digital cameras, or commercially available digital camera chips, may have a relatively low frame rate, for example about 100 frames per second. However, it has been recognised that the information content accessible in a modern digital camera exceeds that required by, for example, a state of-the art Time of Flight mass spectrometer, albeit at insufficient speed. Various embodiments disclosed herein are aimed at overcoming limitations such as the limited frame rate of commercially available digital cameras.

A beam of charged particles may be provided that matches the pixel size of the pixelated detector in order to maximise the amount of data that can be recorded by the detector. For example, a commercially available digital camera chip can be used as the array of sensor pixels, which chip typically has a small pixel size (e.g. <about 10 μm) and/or a low frame rate (e.g. <about 400 frames per second) relative, for example, to conventional fast pixelated detectors used in ion detectors. In order to take advantage of this small pixel size a beam of charged particles or light can be used that is of comparable dimension to the pixel size of the array of sensor pixels as it impinges upon the detector. The beam of charged particles or light may be ions, or representative of ions output from a mass analyser or mass spectrometer.

Various embodiments disclosed herein have a number of advantages over conventional arrangements. A fast temporal signal is transformed to the spatial domain taking advantage of low cost consumer electronics often found in digital cameras. Optical decoupling from high voltage mass spectrometer power supplies to ground potential prevents, for example, arcing damage to sensitive electronics. This optical decoupling is achieved through the use of a phosphor screen, for example, as discussed herein. The ion detector system can be used as a high dynamic range destructive (i.e. not inductive) detector for any mass spectrometer with a time varying output signal. The sweep rate of the deflection plates can be adjusted such that the mass scale is optionally linearized, i.e. the number of pixels per mass to charge ratio is made constant. This is in contrast to conventional Time of Flight detectors that follow a square root time to mass law.

In any of the aspects or embodiments disclosed herein, the detector may have a frame rate of (i) <about 5 frames per second; (ii) about 5-10 frames per second; (iii) about 10-20 frames per second; (iv) about 20-40 frames per second; (v) about 40-60 frames per second; (vi) about 60-80 frames per second; (vii) about 80-100 frames per second; (viii) about 100-200 frames per second; (ix) about 200-400 frames per second; or (x) <about 400 frames per second.

The detector may have a bin width of (i) <about 1 ms; (ii) about 1-2 ms; (iii) about 2-4 ms; (iv) about 4-6 ms; (v) about 6-7 ms; (vi) about 8-10 ms; (vii) about 10-150 ms; (viii) about 150-200 ms; (ix) about 200-500 ms; or (x) >about 500 ms.

The detector may have (i) <about $1\times10^6$ pixels; (ii) about $1\times10^6$-$2\times10^6$ pixels; (iii) about $2\times10^6$-$4\times10^6$ pixels; (iv) about $4\times10^6$-$6\times10^6$ pixels; (v) about $6\times10^6$-$7\times10^6$ pixels; (vi) about $8\times10^6$-$10\times10^6$ pixels; (vii) about $10\times10^6$-$15\times10^6$ pixels; (viii) about $15\times10^6$-$20\times10^6$ pixels; (ix) about $20\times10^6$-$50\times10^6$ pixels; or (x) >about $50\times10^6$ pixels.

The detector may be arranged and adapted to receive a beam of charged particles or light and output data corresponding to the position of the beam of charged particles or light on the array of sensor pixels.

The detector may be arranged and adapted to receive a beam of charged particles or light and output data corresponding to the intensity of the beam of charged particles or light.

The charged particles may be electrons or ions. The light may be photons.

Optionally, the beam of charged particles or light is a beam of electrons produced from, for example, a microchannel plate or conversion dynode.

The detector and/or array of sensor pixels may comprise a charged coupled device ("CCD") and/or a metal-oxide-semiconductor field-effect transistor ("MOSFET").

In some embodiments, the ion detector system may further comprise an aperture arranged and adapted such that a beam of charged particles or light passes through the aperture in use.

In some embodiments, the aperture is a pinhole aperture or slit and may have a dimension comparable to, equal to, or less than the dimension of the sensor pixels.

As used herein, "comparable to" may be taken to mean within about +/−2%, about +/−5%, about +/−10%, about +/−15% or about +/−20% of the dimension referred to.

In any of the aspects or embodiments disclosed herein, the aperture may comprise the object that is viewable at the phosphor screen and/or detector and/or array of sensor pixels. The aperture may have a dimension substantially equal to or less than the width of the beam of charged particles or light immediately prior to impinging upon the aperture.

The aperture may be sized so as to permit: (i) about 0-5%; (ii) about 5-10%; (iii) about 10-15%; (iv) about 15-20%; (iv) about 20-25%; (v) about 25-30%; (vi) about 30-35%; (vii) about 35-40%; (viii) about 40-45%; (ix) about 45-50%; (x) about 50-55%; (xi) about 55-60%; (xii) about 60-65%; (xiii) about 65-70%; (xiv) about 70-75%; (xv) about 75-80%; (xvi) about 80-85%; (xvii) about 85-90%; (xviii) about 90-95%; or (xix) about 95-100% of the charged particles or light in the beam of charged particles or light to pass through the aperture.

The aperture may be circular and may have a maximum and/or minimum dimension of: (i) <about 0.5 μm; (ii) about 0.5-0.1 μm; (iii) about 1-2 μm; (iv) about 2-4 μm; (v) about 4-6 μm; (vi) about 6-8 μm; (vii) about 8-10 μm; (viii) about 10-20 μm; (ix) about 20-40 μm; (x) about 40-60 μm; (xi) about 60-80 μm; (xii) about 80-100 μm; (xiii) about 0.1-0.2 mm; (xiv) about 0.2-0.3 mm; (xv) about 0.3-0.4 mm; (xvi) about 0.4-0.5 mm; (xvii) about 0.5-0.6 mm (xviii) about 0.6-0.7 mm; (xix) about 0.7-0.8 mm; (xx) about 0.8-0.9 mm; or (xxi) about 0.9-1.0 mm.

The ion detector system may comprise a phosphor screen arranged and adapted to receive a beam of charged particles that has passed through the aperture and output a beam of light. The width of the beam of charged particles at the phosphor screen will optionally be substantially equal to the width of the beam of light at the array of sensor pixels. The ion detector system may further comprise a raster device arranged and adapted to sweep a beam of charged particles that has passed through the aperture across the phosphor screen in a raster manner.

The ion detector system may further comprise a first focusing device arranged and adapted to focus a beam of charged particles that has passed through the aperture onto the phosphor screen, and a second focusing device arranged and adapted to focus a beam of light emerging from the phosphor screen onto the detector.

The second focusing device may be arranged and adapted to focus a beam of light emerging from the phosphor screen onto the detector such that, upon impinging the detector, the beam of light has a width comparable to, equal to, or less than the dimension of the sensor pixels.

The ion detector system may further comprise a raster device arranged and adapted to sweep a beam of charged particles that has passed through the aperture across the detector in a raster manner.

The ion detector system may further comprise a first or further focusing device arranged and adapted to focus a beam of charged particles onto the detector.

The first or further focusing device may be arranged and adapted to focus a beam of charged particles onto the detector such that, upon impinging the detector, the beam of charged particles has a width comparable to, equal to, or less than the dimension of the sensor pixels.

The ion detector system may further comprise a control system arranged and adapted to vary a voltage applied to the raster device with the voltage applied to the first focusing device, optionally so as to maintain a width of the beam of charged particles at the phosphor screen or detector comparable to, equal to, or less than the dimension of the sensor pixels.

The ion detector system may be used as a detector for any mass spectrometer giving a time dependent ion output e.g. a quadrupole or Paul trap.

According to an aspect of the disclosure there is provided a mass spectrometer comprising an ion detector system as described above and herein.

The mass spectrometer may further comprise a Time of Flight mass spectrometer or separator. A bin width of the detector may be at least one million times larger than a peak width or cycle time of the Time of Flight mass spectrometer or separator.

According to an aspect of the disclosure there is provided a method comprising detecting ions using a detector comprising an array of sensor pixels, wherein a dimension of the sensor pixels is <about 10 μm.

According to an aspect of the disclosure there is provided a mass spectrometer comprising: an ion detector comprising an array of sensor pixels; and a Time of Flight mass spectrometer or separator; wherein:

a bin width of said ion detector is at least one million times larger than a peak width or cycle time of said Time of Flight mass spectrometer.

The bin width of said ion detector may be >about 1 ms, and the peak width or cycle time of said Time of Flight mass spectrometer or separator may be <about 1 ns.

According to an aspect there is provided a method of mass spectrometry comprising: separating ions in a Time of Flight mass spectrometer or separator; and detecting ions using an ion detector comprising an array of sensor pixels; wherein:

a bin width of said ion detector is at least one million times larger than the peak width or cycle time of said Time of Flight mass spectrometer.

According to an aspect of the disclosure there is provided a method of mass spectrometry comprising the above methods of detecting ions.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, and with reference to the accompanying drawings in which.

DETAILED DESCRIPTION

Various embodiments of the disclosed technology aim to take advantage of the small pixel size of commercially available digital cameras. A small sized electron beam may be used that is substantially equal to or less than the dimension of the pixels of a digital camera. Furthermore, the electron beam may be rapidly swept across a phosphor as described below. An electron beam is optionally scanned in a raster manner across a phosphor scintillator screen, wherein the resultant photons are optionally imaged on the sensor surface of the commercially available digital camera chip. The sensor surface may comprise a charged coupled device ("CCD") or a metal-oxide-semiconductor field-effect transistor ("MOSFET").

Figure 1:
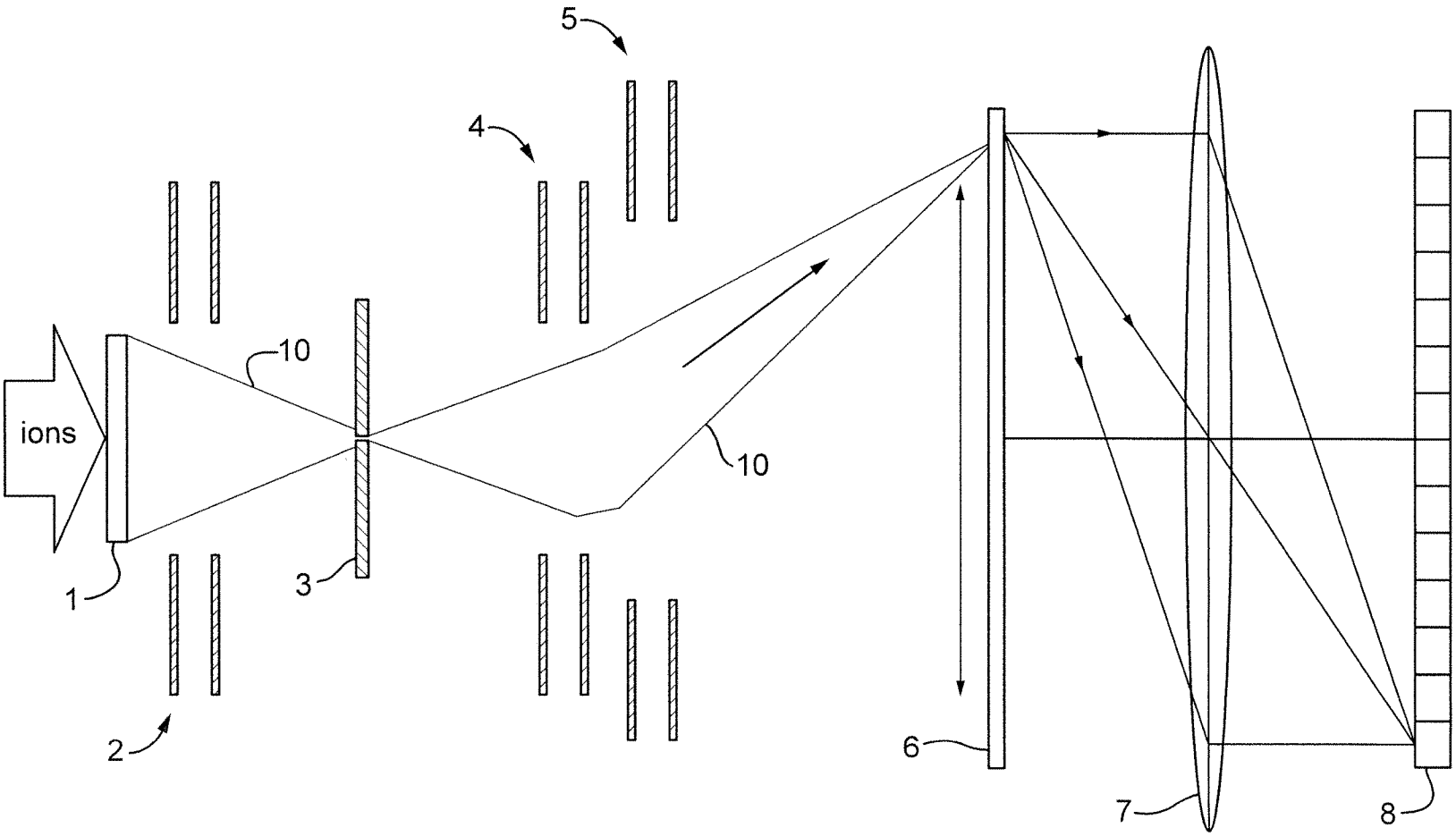
FIG. 1 shows an ion detection system for a mass spectrometer according to an embodiment wherein electrons emitted from a microchannel plate detector are deflected on to a phosphor screen so as to produce photons which are focused by an optical lens onto a Charge Coupled Device ("CCD") or camera sensor.

FIG. 1 shows an ion detection system in accordance with various embodiments. A microchannel plate 1 is optionally arranged to receive ions from a Time of Flight mass spectrometer. The microchannel plate 1 optionally amplifies the signal and optionally produces or outputs a beam of electrons 10. The beam of electrons 10 is optionally focused down through a pinhole aperture 3 optionally using a first focusing lens 2. The pinhole aperture 3 optionally serves as the object for a subsequent imaging system or camera sensor 8 which will be described in more detail below. The electrons are deflected onto a phosphor screen 6 and photons are released from the phosphor screen which are focused by an optical lens 7 on to a Charged Coupled Device array or camera sensor 8.

Conventionally, electrons produced from a conversion dynode at the end of a Time of Flight mass spectrometer may be bent and focused by magnetic and/or electric fields and directed towards a phosphor screen. However, the energy distribution of the released photoelectrons prohibited the tight focus (for example about 10 μm) required to match the pixel size of a commercially available digital camera. As discussed above, a microchannel plate 1 may be provided to amplify the fast signal from a Time of Flight mass spectrometer and optionally output a beam of electrons 10.

In accordance with the disclosure, the beam of electrons 10 may be focused down through a pinhole aperture 3 having a dimension comparable to, equal to or less than the dimension of the sensor pixels. The pinhole aperture 3 serves as the object or virtual object for the subsequent imaging system, and selects the output electrons from the microchannel plate 1 that have an amenable energy and position to be focused through the pinhole aperture 3.

According to an embodiment, the attrition rate of the electrons may be relatively high, with most electrons failing to be focused through the aperture. However, even a single stage microchannel plate can be operated at a gain of about 10,000 i.e. about 10,000 electrons per ion strike and only a fraction of a percent of output electrons are needed.

A single electron at an incoming kinetic energy of about 5 keV or so arriving at the phosphor screen 6 may be expected to yield at least one photon from the rear of the phosphor screen 6. Considering that the quantum efficiency of the camera sensor 8 may be high, the whole system is optionally capable of registering single ion strikes at the microchannel plate input surface which is all that may be required for a destructive mass spectrometer detector.

After passing through the pinhole aperture 3, which may be, for example, about 10 μm or less in diameter, the beam of electrons 10 is optionally focused by a second focusing lens 4. The beam of electrons 10 is then optionally deflected in orthogonal X and Y directions by deflection plates or electrodes 5 optionally onto the phosphor screen 6.

The grain size of the phosphor screen 6 is optionally smaller than the electron beam image of the aperture. The emitted photons may be reimaged onto a camera sensor 8. The camera sensor may comprise a charged coupled device ("CCD") or a metal-oxide-semiconductor field-effect transistor ("MOSFET"), that is optionally of the type found in commercially available digital cameras i.e. pixelated and optionally having a pixel size of about 5 μm or less than about 10 μm.

The electron to photon conversion stage at the phosphor screen 6 optionally advantageously decouples the high voltages found in the mass spectrometer from the sensitive low voltage of the digital camera chip 8 thereby preventing damage to the digital camera 8 due to, for example, electric discharges that can be prevalent in mass spectrometers.

The resolution of the acquired signal on the camera sensor 8 may be limited by the number of pixels addressed in the mass dispersive direction. To mitigate this problem, the beam of electrons 10 can be deflected or swept across the phosphor screen 6 in optionally a raster manner, optionally using a sawtooth waveform. Other scan patterns are also contemplated. The light from the phosphor screen 6 is, in turn, optionally deflected or swept across the camera sensor 8 by deflection plates 5.

Figure 2:
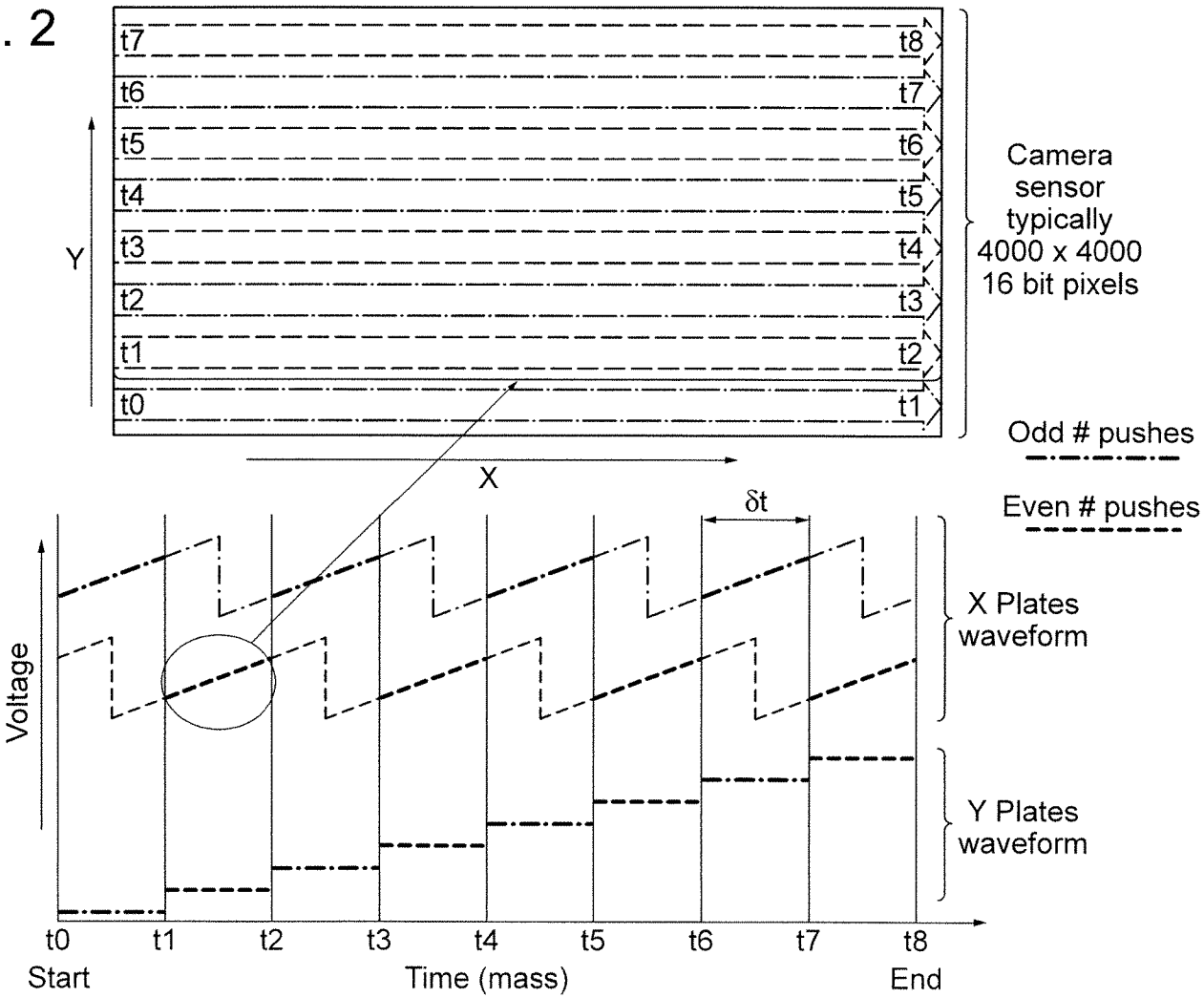
FIG. 2 shows the scanning pattern of light across a pixelated detector according to an embodiment.

FIG. 2 shows an example of how the photon beam from the phosphor screen 6 may be scanned as a raster across the surface of the camera sensor 8 to optionally produce a mass spectrum.

For illustrative purposes the case of an orthogonal acceleration Time of Flight mass spectrometer may be considered with a high speed pusher unit and a total time of flight of (t8–t0) wherein t0 is the start time and t8 the time taken for all ions of interest to reach the detector when the pusher can fire again.

In FIG. 2 the time or mass dispersion occurs on the X axis, and the Time of Flight is split into eight equal sections of time. The pusher of the Time of Flight mass spectrometer may fire at t0 and the voltage on the X deflection plate optionally sweeps the light from the phosphor screen 6 across the camera sensor 8 to encompass the first time window of interest t0 to t1. The first time window corresponds to the start of the mass scale. The sawtooth optionally returns to zero, and in the meantime the voltage on the Y plate may be incremented to deflect the beam to an unexposed part of the camera sensor 8 in readiness for the sawtooth to sweep the beam across in the X direction between times t2 to t3.

The process optionally repeats itself until, for example, the time t6 to t7 is covered, after which approximately half of the spectrum is recorded. The pusher may then fire again and the process may be repeated to fill in the gaps t1 to t3 and up to t7 to t8 when the entire mass spectrum will be filled in.

In an orthogonal acceleration Time of Flight mass spectrometer the time for two mass spectra (pushes) is typically about 100 ms, and this may be the cycle time for acquisition of a whole mass spectrum in this case. Provided that the phosphor signal has decayed during this period, the whole process can be repeated again and again and leading to an integrated signal on the camera sensor that can be read out at the frame rate of the device. The frame rate for a commercially available digital camera may be about 100 frames per second or greater than about 100 frames per second.

In the example given the mass scale is split into eight parts and a commercially available digital camera may have about 4000 pixels across, which may provide about 32,000 16-bit samples across the mass scale. By sweeping the electrode voltage faster more pixels can be accessed in the time dimension, and the number of samples across the mass scale increased.

In order to keep the camera sensor 8 to compact dimensions the beam of electrons 10 may be deflected or swept through as large an angle as possible by the deflection plates 5. This reduces the distance between the deflection plates 5 and the phosphor screen 6.

At larger deflection angles defocusing of the beam of electrons 10 may occur and hence the focal plane may change. To keep the spot size of the beam of electrons 10 to a minimum the voltage applied to the second focusing lens 4 may change with the voltage applied to the deflection plates 5. Such a method is known as dynamic focusing.

Although the present invention has been described with reference to various embodiments, it will be understood by those skilled in the art that various changes in form and detail may be made without departing from the scope of the invention as set forth in the accompanying claims.

The invention claimed is:

1. An ion detector system for a mass spectrometer, comprising:

a detector comprising an array of sensor pixels, wherein a dimension of said sensor pixels is <10 μm;

an aperture arranged and adapted such that a beam of charged particles or light passes through said aperture in use, wherein said aperture comprises a pinhole aperture or slit having a dimension comparable to, equal to, or less than said dimension of said sensor pixels.

2. An ion detector system as claimed in claim 1, wherein said detector has a frame rate <250 frames per second and/or a bin width >4 ms.

3. An ion detector system as claimed in claim 1, wherein said detector has >1×106 pixels.

4. An ion detector system as claimed in claim 1, wherein said detector is arranged and adapted to receive a beam of charged particles or light and output data corresponding to the position of said beam of charged particles or light on said array of sensor pixels.

5. An ion detector system as claimed in claim 1, wherein said detector is arranged and adapted to receive a beam of charged particles or light and output data corresponding to the intensity of said beam of charged particles or light.

6. An ion detector system as claimed in claim 1, further comprising a phosphor screen arranged and adapted to receive a beam of charged particles that has passed through said aperture and output a beam of light.

7. An ion detector system as claimed in claim 6, further comprising a raster device arranged and adapted to sweep a beam of charged particles that has passed through said aperture across said phosphor screen in a raster manner.

8. An ion detector system as claimed in claim 6, further comprising a first focusing device arranged and adapted to focus a beam of charged particles that has passed through said aperture onto said phosphor screen, and a second focusing device arranged and adapted to focus a beam of light emerging from said phosphor screen onto said detector.

9. An ion detector system as claimed in claim 8, wherein said second focusing device is arranged and adapted to focus a beam of light emerging from said phosphor screen onto said detector such that, upon impinging said detector, said beam of light has a width comparable to, equal to, or less than said dimension of said sensor pixels.

10. An ion detector system as claimed in claim 1, further comprising a raster device arranged and adapted to sweep a beam of charged particles that has passed through said aperture across said detector in a raster manner.

11. An ion detector system as claimed in claim 10, further comprising a first focusing device arranged and adapted to focus a beam of charged particles onto said detector.

12. An ion detector system as claimed in claim 11, wherein said first focusing device is arranged and adapted to focus a beam of charged particles onto said detector such that, upon impinging said detector, said beam of charged particles has a width comparable to, equal to, or less than said dimension of said sensor pixels.

13. An ion detector system as claimed in claim 7, further comprising a control system arranged and adapted to vary a voltage applied to said raster device with the voltage applied to said first focusing device so as to maintain a width of the beam of charged particles at said phosphor screen or detector comparable to, equal to, or less than said dimension of said sensor pixels.

14. A mass spectrometer comprising an ion detector system as claimed in claim 1.

15. A method of detecting ions comprising:

providing a detector comprising an array of sensor pixels, wherein a dimension of said sensor pixels is <10 μm and an aperture; and passing a beam of charged particles or light through said aperture, wherein said aperture comprises a pinhole aperture or slit having a dimension comparable to, equal to, or less than said dimension of said sensor pixels.

16. A method of mass spectrometry comprising a method as claimed in claim 15.

* * * * *